US005598585A

United States Patent [19]

Stroup

[11] Patent Number: 5,598,585

[45] Date of Patent: Feb. 4, 1997

[54] HEADBAND WITH PONYTAIL HOLDER

[76] Inventor: Katherine L. Stroup, 59 Sheafe St., Portsmouth, N.H. 03801

[21] Appl. No.: 490,875

[22] Filed: Jun. 15, 1995

[51] Int. Cl.[6] ..... A42C 5/02

[52] U.S. Cl. ..... 2/171; 2/DIG. 11; 132/273

[58] Field of Search ..... 2/171, DIG. 11, 2/181, 181.2, 181.6, 183; 132/212, 273, 275; D2/865, 871, 874, 875, 877, 881, 884, 894

[56] References Cited

U.S. PATENT DOCUMENTS 4,998,544 3/1991 Obergfell ..... 132/212

FOREIGN PATENT DOCUMENTS 785551 8/1935 France ..... 132/273

283240 1/1914 Germany ..... 2/183

*Primary Examiner*—Diana Biefeld

*Attorney, Agent, or Firm*—Kriegsman & Kriegsman

[57] ABSTRACT

A headband designed particularly, but not limited exclusively, for a person having a ponytail includes an elongated member having an inner surface, an outer surface, a first generally U-shaped end having a pair of outwardly extending legs, and a second generally U-shaped end having a pair of outwardly extending legs. The headband further includes a pair of hook-type VELCRO strips placed on the outer surface of the outwardly extending legs of the first generally U-shaped end and a pair of loop-type VELCRO strips, fastenable with the pair of hook-type VELCRO strips, placed on the inner surface of the outwardly extending legs of the second generally U-shaped end. The pair of hook-type VELCRO strips and the pair of loop-type VELCRO strips serve as a means for attaching the first generally U-shaped end to the second generally U-shaped end. The attachment of the first generally U-shaped end to the second generally U-shaped end creates a generally oval opening enabling the pony tail to pass therethrough. The headband is made a layer of soft inner material and a layer of durable and resistant outer material which are stitched together.

2 Claims, 2 Drawing Sheets

HEADBAND WITH PONYTAIL HOLDER

BACKGROUND OF THE INVENTION

The present invention relates generally to headbands and more particularly to a headband designed especially for use by a person whose hair is arranged to form a ponytail.

Headbands are well-known in the art and have been designed for a plurality of different purposes. For example, headbands have often been designed for ornamental purposes. Examples of this type of headband include a hair wrap disclosed in U.S. Pat. No. Des. 347,311, a headband disclosed in U.S. Pat. No. Des. 316,774, a headband as disclosed in U.S. Pat. No. Des. 343,282, a headband as disclosed in U.S. Pat. No. Des. 277,330, and a headband having a self-adhesive portion as disclosed in U.S. Pat. No. Des. 340,345.

Other known purposes for which headbands have been specifically designed include medical headbands, which aid in the treatment of head injuries, and headbands which absorb perspiration on a person's brow.

However, none of the headbands which are well-known in the art are designed specifically to accommodate use by a person having a ponytail. To serve their functionality, headbands are ideally worn around the user's brow in such a manner that the headband passes over the base of the ponytail of the person. The person is, accordingly, forced to move the headband either above the ponytail or below the ponytail. If the person moves the headband above the ponytail, the headband would no longer be on the brow of the person as desired and may become loose and eventually move up and off the head of the person. On the other hand, if the person moves the headband below the ponytail, the headband falls below the brow of the person and conceivably around the eyes of the user thereby impairing the line of vision of the person. As a consequence, people who have a ponytail are often precluded from wearing such headbands and are denied their utility or ornamentality.

Also well-known in the art are conventional baseball caps which include two elongated members attached to the body of the cap. The elongated members are connectable at various positions and serve the function of enabling a single hat to conform to a large variety of hat sizes. As a consequence of the structure of this type of cap, a small opening in the rear of the cap is created. However, this opening was not designed for a person having a ponytail to wear the cap, but rather as a necessary element in making a hat which can be adjusted to fit different size heads. It should be noted that as the elongated members are brought closer together and are subsequently attached thereby decreasing the cap size, the size of the opening decreases, possibly to the extent that a ponytail would no longer be able to pass through. An example of such a cap may be found in U.S. Pat. No. 5,355,535.

SUMMARY OF THE INVENTION

It is an object of the present invention to provide a new and improved headband.

It is another object of the present invention to provide a headband which could be worn by a person having a pony tail.

In accordance with the objects set forth above and hereafter made apparent from the description of the invention, a headband designed particularly, but not limited exclusively, for use by a person having a ponytail, constructed according to the teachings of the present invention is provided which comprises an elongated member having an inner surface, an outer surface, a first generally U-shaped end having a pair of outwardly extending legs, a second generally U-shaped end having a pair of outwardly extending legs, and means for releasably securing the pair of outwardly extending legs on the first generally U-shaped end to the pair of outwardly extending legs on the second generally U-shaped end, wherein once the pair of outwardly extending legs on the first generally U-shaped end are releasably secured to the pair of outwardly extending legs on the second generally U-shaped end, an opening through which the ponytail can be passed through is created.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF DRAWINGS

The accompanying drawings, which are hereby incorporated into and consume a part of this specification, illustrate an embodiment of the present invention and, together with the description, serve to explain the principles of the invention. In these drawings wherein like reference numerals represent like parts.

DETAILED DESCRIPTION OF PREFERRED EMBODIMENTS

Figure 1:
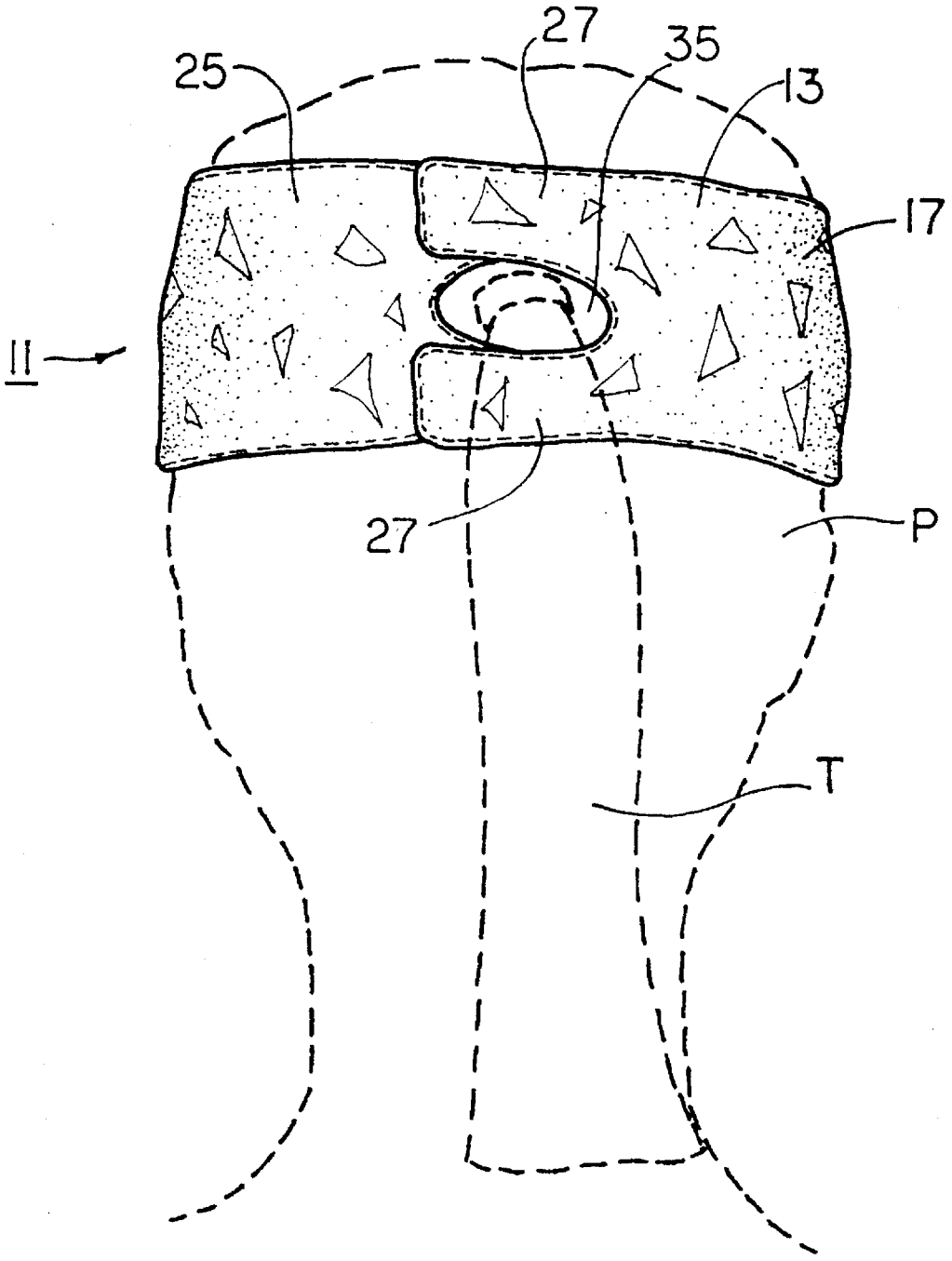
FIG. 1 is a rear perspective view of a headband shown on the head of a person constructed according to the teachings of the present invention.
Figure 5:
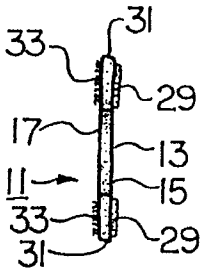
FIG. 5 is an end elevational view of the headband shown in FIG. 1.
Figure 2:
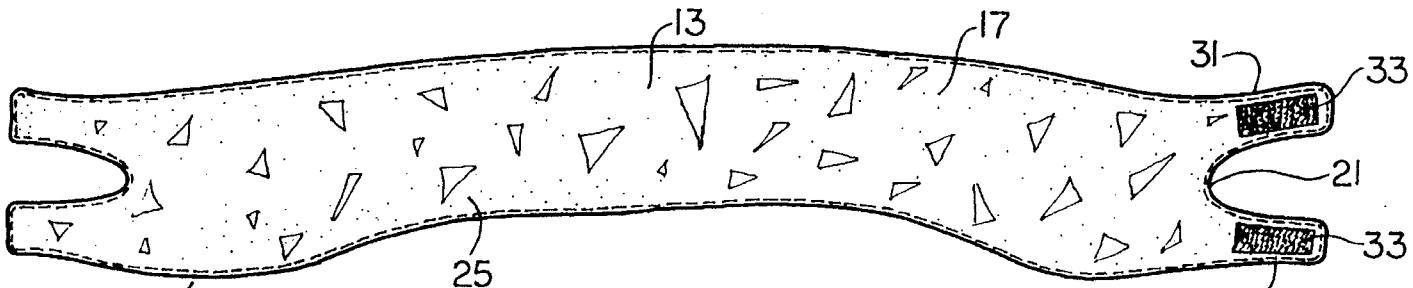
FIG. 2 is a front elevational view of the headband shown in FIG. 1.
Figure 3:
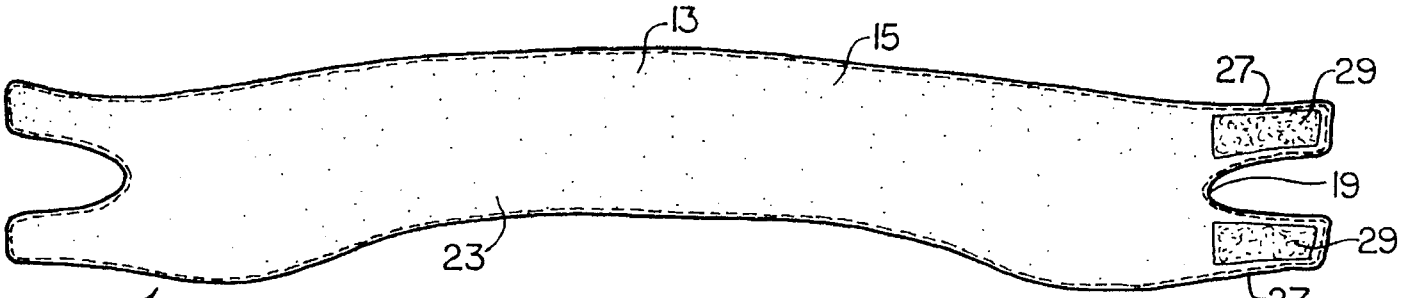
FIG. 3 is a back elevational view of the headband shown in FIG. 1.
Figure 4:
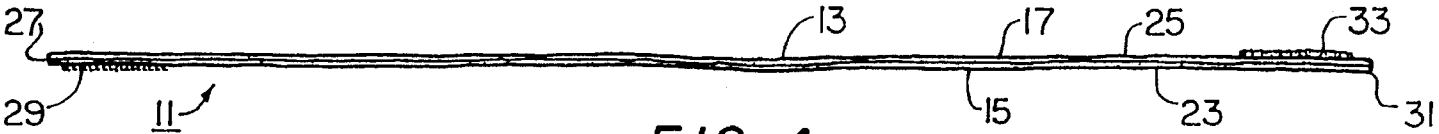
FIG. 4 is a bottom plan view of the headband shown in FIG. 1.

Referring now to the drawings, there is shown in FIGS. 1–5 a headband constructed according to the teachings of the present invention, the headband being represented generally by reference numeral 11. In FIG. 1, headband 11 is shown on a person P having a ponytail T.

Headband 11 includes an elongated member 13. Elongated member 13 has an inner surface 15, and outer surface 17, a first generally U-shaped end 19, and a second generally U-shaped end 21. Elongated member 13 comprises an inner layer of material 23 and an outer layer of material 25 which are stitched together. Inner layer 23 is made of a soft material, such as cotton or fleece, to prevent irritation on person P. Outer layer 25 is made of a more durable and resistant material, such as polyester, to maintain the shape and cleanliness of headband 11. Additionally, outer layer 25 may be made of a specific pattern or design as desired by person P.

First generally U-shaped end 19 is shaped to provide a pair of outwardly extending legs 27. A pair of loop-type VELCRO strips 29 are stitched on the inner surface 15 of outwardly extending legs 27.

Second generally U-shaped end 21 is shaped to provide a pair of outwardly extending legs 31. A pair of hook-type VELCRO strips 33, fastenable with the first pair of loop-type VELCRO strips 29, are stitched on the outer surface 17 of outwardly extending legs 31.

Headband 11 may be used in the following manner. First, inner surface 15 is placed person P so that first generally U-shaped end 19 and second generally U-shaped end 21 converge towards ponytail T. Second generally U-shaped end 21 is then pressed against person P so that ponytail T is situated between outwardly extending legs 31. Finally, first generally U-shaped end 19 is positioned over second generally U-shaped end 21 so that pair of loop-type VELCRO strips 29 and pair of hook-type VELCRO strips 31 are fastened together, thereby creating a generally oval opening 35 which ponytail T passes therethrough.

By pulling first generally U-shaped end 19 off of second generally U-shaped end 21, headband can be removed from person P.

The embodiment of the present invention described above is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A headband designed particularly, but not limited exclusively, for use by a person having a ponytail, comprising:

a) an elongated band having an inner surface, an outer surface, a first generally U-shaped end having a pair of outwardly extending legs disposed in side-by-side relationship, and a second generally U-shaped end having a pair of outwardly extending legs disposed in side-by-side relationship; and b) means for releasably securing the pair of outwardly extending legs on the first generally U-shaped end to the pair of outwardly extending legs on the second generally U-shaped end, so as to form an opening in between the outwardly extending legs of the first and second U-shaped ends through which the ponytail can pass through.

2. The headband as recited in claim 1 wherein said elongated band comprises an inner layer constructed of a soft material to prevent irritation on the person and an outer layer constructed of a durable and resistant material to maintain shape and cleanliness, said inner layer and said outer layer being stitched together around their peripheries and wherein said first and second generally U-shaped ends are releasably securable by hook and loop fasteners so as to form an oval shaped opening in between the outwardly extending legs.

* * * * *